US009546474B2

(12) United States Patent
Cochart

(10) Patent No.: US 9,546,474 B2
(45) Date of Patent: Jan. 17, 2017

(54) SYSTEM, APPARATUS AND METHOD FOR CREATING AND/OR DISPENSING A MIXTURE OF WATER AND A PERSONAL CARE LIQUID

(71) Applicant: Kohler Co., Kohler, WI (US)

(72) Inventor: Chad J. Cochart, Sheboygan, WI (US)

(73) Assignee: KOHLER CO.

( * ) Notice: Subject to any disclaimer, the term of this patent is extended or adjusted under 35 U.S.C. 154(b) by 475 days.

(21) Appl. No.: 14/090,969

(22) Filed: Nov. 26, 2013

(65) Prior Publication Data

US 2014/0143948 A1 May 29, 2014

Related U.S. Application Data

(60) Provisional application No. 61/729,648, filed on Nov. 26, 2012.

(51) Int. Cl.

| | |
|---|---|
| ***G01F 11/28*** | (2006.01) |
| ***E03C 1/046*** | (2006.01) |
| *A47K 5/12* | (2006.01) |

(52) U.S. Cl.

CPC ..... *E03C 1/046* (2013.01); *A47K 2005/1218* (2013.01); *A47K 2210/00* (2013.01)

(58) Field of Classification Search

CPC ..... E03C 1/046; A47K 2005/1218; A47K 2210/00; G01F 11/00; G01F 11/28; G01F 15/005

USPC ..... 4/676; 222/425; 137/459, 505, 505.14, 137/505.15, 500, 501, 502; 239/10, 310, 239/318

See application file for complete search history.

(56) References Cited

U.S. PATENT DOCUMENTS

| | | | | |
|---|---|---|---|---|
| 3,639,920 | A | 2/1972 | Griffin et al. | |
| 3,907,203 | A * | 9/1975 | Skillings | E03C 1/0465 239/314 |
| 4,248,266 | A | 2/1981 | Queen | |
| 4,518,013 | A | 5/1985 | Lazarus | |
| 4,942,631 | A | 7/1990 | Rosa | |
| 5,765,242 | A | 6/1998 | Marciano | |
| 5,781,942 | A | 7/1998 | Allen et al. | |
| 5,863,128 | A | 1/1999 | Mazzei | |
| 5,906,319 | A * | 5/1999 | Crowl | E03C 1/046 239/310 |
| 5,961,049 | A | 10/1999 | Kaps et al. | |
| 5,966,753 | A | 10/1999 | Gauthier et al. | |
| 6,125,482 | A | 10/2000 | Foster | |
| 6,236,953 | B1 | 5/2001 | Segal | |
| 6,293,294 | B1 | 9/2001 | Loeb et al. | |
| 6,314,980 | B1 | 11/2001 | Beswick et al. | |
| 7,073,215 | B1 | 7/2006 | Berke et al. | |

(Continued)

*Primary Examiner* — J. Casimer Jacyna
*Assistant Examiner* — Benjamin R Shaw
(74) *Attorney, Agent, or Firm* — The Belles Group, P.C.

(57) ABSTRACT

A system for dispensing or and/or creating a mixture of water and a personal care liquid (PC), such, as soap, shampoo, antibacterial liquids, disinfectant liquids, liquid dishwashing detergents, or other sanitization fluids. The system, in one embodiment, is used in conjunction with a faucet that is mounted adjacent a washbasin to dispense the mixture. In an embodiment, a mixing unit is included in the system that comprises a venturi and a pressure compensating control device. In another embodiment, a pinch valve is utilized to control the introduction of the PCL into the water flow. In yet another embodiment, at least one water pressure actuatable valve is utilized to control the introduction of the PCL into the water flow.

17 Claims, 9 Drawing Sheets

(56) References Cited

U.S. PATENT DOCUMENTS

| | | | | |
|---|---|---|---|---|
| 7,363,938 | B1 * | 4/2008 | Newton | G05D 16/0672 137/315.05 |
| 2002/0070294 | A1 * | 6/2002 | Bertrand | B05B 7/30 239/318 |
| 2004/0113288 | A1 | 6/2004 | Korzeniowski | |
| 2005/0150556 | A1 | 7/2005 | Jonte | |
| 2005/0150909 | A1 * | 7/2005 | Leonard | E03C 1/046 222/181.3 |
| 2006/0011746 | A1 * | 1/2006 | De Simone | E03C 1/046 239/311 |
| 2006/0101575 | A1 * | 5/2006 | Louis | E03C 1/046 4/676 |
| 2006/0151635 | A1 | 7/2006 | Laker | |
| 2006/0162120 | A1 * | 7/2006 | Brice | B05B 7/0425 15/409 |
| 2006/0163391 | A1 | 7/2006 | Schorn | |
| 2007/0119980 | A1 * | 5/2007 | Somerfield | E03C 1/046 239/302 |
| 2009/0000024 | A1 | 1/2009 | Louis et al. | |
| 2010/0044455 | A1 | 2/2010 | Paoluccio | |
| 2012/0006912 | A1 | 1/2012 | Ho | |
| 2012/0018000 | A1 * | 1/2012 | Strauli | E03C 1/046 137/1 |
| 2013/0056086 | A1 * | 3/2013 | Strauli | A47K 5/12 137/15.01 |
| 2015/0315771 | A1 * | 11/2015 | Abramson | E03C 1/046 4/678 |

* cited by examiner

SYSTEM, APPARATUS AND METHOD FOR CREATING AND/OR DISPENSING A MIXTURE OF WATER AND A PERSONAL CARE LIQUID

CROSS-REFERENCE TO RELATED APPLICATIONS

The present application claims the benefit of U.S. Provisional Patent Application Ser. No. 61/729,648, filed Nov. 26, 2012, the entirety of which is hereby incorporated by reference.

FIELD OF THE INVENTION

The present invention relates generally to systems, apparatus, and methods for creating and/or dispensing a mixture of water and a personal care liquid, such as soap, shampoo, antibacterial liquids, disinfectant liquids, liquid dishwashing detergents, or other sanitization fluids, and specifically to systems, apparatus, and methods that utilize a faucet adjacent a washbasin to dispense the mixture.

BACKGROUND OF THE INVENTION

Currently, personal cleaning liquids, such as liquid soap, shampoo, antibacterial liquids, disinfectant liquids, liquid dishwashing detergents and other sanitization fluids, are typically applied in full strength and thereafter diluted and rinsed with water. One drawback of the current practice is that personal care liquids are often stored at random locations, and are difficult to find. Another drawback is that the use of personal care liquids during a regiment, such as washing hands, varies greatly among individuals. Another drawback is that people may merely rinse their hands with water and not use the personal care liquids as should be during as prescribed washing regiment. This can be especially troublesome in certain industries such as, food preparation and food serving, child care, medical care, and other service-based industries. Another drawback is that in systems that utilize dispensers for personal care liquids that are located adjacent the washbasin, the personal care liquid tends to become caked within the washbasin and on the surrounding surfaces, whether it be by leakage from the dispenser and/or as a result of the user's interaction with the dispenser and/or the washbasin.

In an attempt to facilitate hand washing and eliminate the above-mentioned dispenser that dispense undiluted personal care liquids directly to the user, several systems have been developed that dispense a mixture of water and a personal care liquids (such as liquid soap) have been proposed. Examples of such systems are disclosed in: (1) U.S. Pat. No. 7,073,215, issued Jul. 11, 2006 to Berke et al.; (2) U.S. Patent Application Publication No. 2009/0000024, published Jan. 1, 2009 to Louis et al.:, (3) U.S. Pat. No. 5,906,319, issued May 25, 1999 to Crowl et al.; (4) U.S. Pat. No. 6,125,482, issued Oct. 3, 2000 to Foster; (5) U.S. Pat. No. 4,248,266, issued Feb. 3, 1981 to Queen; and (6) U.S. Patent Application Publication No. 2006/0101575, issued May 18, 2006 to Louis.

While the above-referenced systems, methods and apparatus are an improvement over standard operation in which water is dispensed from a faucet and the personal care liquid is dispensed separately, each of these systems, methods and apparatus suffer from a number of drawbacks. Such drawbacks include complexity of the fluid circuits and associated components, excessive requirements of electrical power, and/or inability to create a reliable and consistent proportion of personal care liquid to water in the mixture. Moreover, many, if not all, of these systems fail to properly compensate for upstream pressure variances, thereby resulting in said complexity and or unpredictable results.

The present invention seeks to solve these and other deficiencies and provide an improved system, apparatus and method for creating and/or dispensing a mixture of water and a personal care liquid, such as soap, shampoo, antibacterial liquids, disinfectant liquids, liquid dishwashing detergents, or other sanitization

SUMMARY OF THE INVENTION

The present invention, in one embodiment, is directed to a dispensing system comprising: a faucet; a personal care liquid (PCL) reservoir; a PCL supply line fluidly coupled to the PCL reservoir; a water supply line; a mixing unit comprising: a first passageway extending from a water inlet to an outlet, the first passageway comprising a mixing chamber comprising a venturi constriction; a second passageway extending from a PCL inlet to a PCL outlet in the mixing chamber; a pressure compensating flow control (PCFC) device operably disposed in the first passageway between the venturi constriction and the water inlet; the water supply line fluidly coupled to the water inlet of the mixing unit and the PCL supply line fluidly coupled to the PCL inlet; and a dispensing line fluidly coupled to the outlet of the first passageway of the mixing unit and to the faucet.

In another embodiment, the invention can he a personal care liquid (PCL) supply system comprising: a personal care liquid (PCL) reservoir; a PCL supply line fluidly coupled to the PCL reservoir; a mixing unit comprising: a body; a first passageway in the body extending from a water inlet configured to be fluidly coupled to a water supply line to an outlet configured to be fluidly coupled to a dispensing line, the first, passageway comprising a mixing chamber comprising a venturi constriction; a second passageway in the body extending from a PCL inlet to a PCL outlet in the mixing chamber; a pressure compensating flow control (PCFC) device operably disposed in the first passageway between the venturi constriction and the water inlet; and the PCL supply line fluidly coupled to the PCL inlet.

In vet another embodiment, the invention can be a mixing unit comprising: a body; a first passageway in the body extending from a water inlet configured to be fluidly coupled to a water supply line to an outlet configured to be fluidly coupled to a dispensing line, the first passageway comprising a mixing chamber comprising a venturi constriction; a pressure compensating flow control (PCFC) device operably disposed in the first passageway between the venturi constriction and the water inlet; and a second passageway in the body extending from a personal care liquid (PCL) inlet configured to be fluidly coupled to a PCL supply line to a PCL outlet in the mixing chamber.

In still another embodiment, the invention can be a personal care liquid (PCL) refill apparatus comprising; a container comprising a volume of PCL; a PCL supply line fluidy coupled to the container, the PCL supply line comprising a resilient conduit having a free end configured to be detachably coupled to a PCL inlet of a mixing, unit, the free end comprising a metered orifice for dispensing PCL; a visual indicia on the resilient conduit at a first location on the resilient conduit upstream of the metered orifice; and wherein the resilient tube comprises a metered volume between the first location and the metered orifice.

In a further embodiment, the invention can be a personal care liquid (PCL) refill apparatus comprising: a collapsible container comprising a volume of PCL; and a PCL supply line fluid y coupled to the collapsible container, the PCL supply line comprising a resilient conduit having a free end comprising a plug that is configured to be detachably coupled to a PCL inlet of a mixing unit, the plug comprising a PCL delivery passageway comprising a metered orifice.

In a yet further embodiment, the invention can be a personal care liquid (PCL) refill apparatus comprising: a container comprising a volume of PCL; a PCL supply line fluidy coupled to the container, the PCL supply line comprising a resilient conduit having a free end configured to be detachably coupled to a PCL inlet of a mixing unit; a first visual indicia on the resilient conduit at a first location on the resilient conduit; a second visual indicia on the resilient conduit at a second location on the resilient conduit, the second location being upstream of the first location; and wherein the resilient tube comprises a metered volume between the first location and the second location.

In a still further embodiment, the invention can be a dispensing system comprising: a faucet; a personal care liquid (PCL) reservoir; a PCL supply line fluidly coupled to the PCL reservoir and comprising a resilient conduit having a free end; a pinch valve operably coupled to the resilient conduit, the pinch valve actuatable between: (1) a closed position in which the pinch valve compresses the resilient conduit at a first location to seal the resilient conduit; and (2) an open position in which the pinch valve does not compress the resilient conduit so that PCL can freely flow through the resilient conduit; a water supply line; a mixing unit comprising: a first passageway extending from a water inlet to an outlet, the first passageway comprising a mixing chamber comprising a venturi constriction; a second passageway extending from a PCL inlet to a PCL outlet in the mixing chamber; the water supply line fluidly coupled to the water inlet of the mixing unit and the free end of the resilient conduit of the PCL supply line detachably coupled to the PCL inlet in a fluid-tight manner; and a dispensing line fluidly coupled to the outlet of the first passageway of the mixing unit and to the faucet.

In an even further embodiment, the invention can be a personal care product (PCL) supply system comprising: a personal care liquid (PCL) reservoir; a PCL supply line fluidly coupled to the PCL reservoir and comprising a resilient conduit having a free end; a pinch valve operably coupled to the resilient conduit, the pinch valve actuatable between: (1) a closed position in which the pinch valve compresses the resilient conduit at a first location to seal the resilient conduit; and (2) an open position in which the pinch valve does not compress the resilient conduit so that PCL can freely flow through the resilient conduit; a mixing unit comprising: a first passageway extending from a water inlet configured to be fluidly coupled to a water supply line to an outlet configured to be fluidly coupled to a dispensing line, the first passageway comprising a mixing chamber comprising a venturi constriction; a second passageway extending from a PCL inlet to a PCL outlet in the mixing chamber; the free end of the resilient conduit of the PCL supply line detachably coupled to the PCL inlet in a fluid-tight manner.

In a yet even further embodiment, the invention can be a dispensing system comprising: a faucet; a personal care liquid (PCL) reservoir; a PCL, supply line fluidly coupled to the PCL reservoir; a water supply line; a mixing unit comprising: a first passageway extending from a water inlet to an outlet, the first passageway comprising a mixing chamber comprising a venturi constriction; a second passageway extending from a PCL inlet to a PCL outlet in the mixing chamber; the water supply line fluidly coupled to the water inlet of the mixing unit and the PCL supply line fluidly coupled to the PCL inlet; a dispensing line fluidly coupled to the outlet of the first passageway of the mixing unit and to the faucet; a valve line fluidly coupled to one of the dispensing line or the water supply line; a normally open water pressure activated valve operably coupled to the valve line to be actuatable between: (1) an open state in which the PCL line is open at a location; and (2) a closed state in which the normally open water pressure activated valve seals the PCL supply at the location; and wherein water pressure of water flowing through the valve line actuates the normally open water pressure activated valve into the closed state.

In another embodiment, the invention can be a personal care liquid (PCL) supply system comprising: a personal care liquid (PCL) reservoir; a PCL supply line fluidly coupled to the PCL, reservoir; a mixing unit comprising: a first passageway extending from a water inlet configured to be fluidly coupled to a water supply line to an outlet configured to be fluidly coupled to a dispensing line; the first passageway comprising a mixing chamber comprising, a venturi constriction; a second passageway extending from a PCL inlet to a PCL outlet in the mixing chamber, the PCL supply line fluidly coupled to the PCL inlet; a valve unit comprising: a valve line fluidly coupled to one of the water inlet or the outlet of the first passageway; a normally open water pressure activated valve operably coupled to the valve line to be actuatable between: (1) an open state in which the PCL line is open at a location; and (2) a closed state in which the normally open water pressure activated valve seals the PCL supply at the location; and wherein water pressure of water flowing through the valve line actuates the normally open water pressure activated valve into the closed state.

In yet another embodiment, the invention can be a personal care liquid (PCL) control system comprising: a mixing unit comprising: a body; a first passageway in the body extending from a water inlet configured to be fluidly coupled to a water supply line to an outlet configured to be fluidly coupled to a dispensing line, the first passageway comprising a mixing chamber comprising a venturi constriction; a second passageway in the body extending from a PCL inlet configure to be fluidly coupled to a PCL supply line to a PCL outlet in the mixing chamber; a valve unit comprising: a valve line fluidly coupled to one of the water inlet or the outlet of the first passageway; a normally open water pressure activated valve operably coupled to the valve line to be actuatable between: (1) an open state; and (2) a closed state; and wherein water pressure of water flowing, through the valve line actuates the normally open water pressure activated valve from the open state into the closed state.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description. and the accompanying drawings, wherein.

DETAILED DESCRIPTION OF THE DRAWINGS

Figure 1:
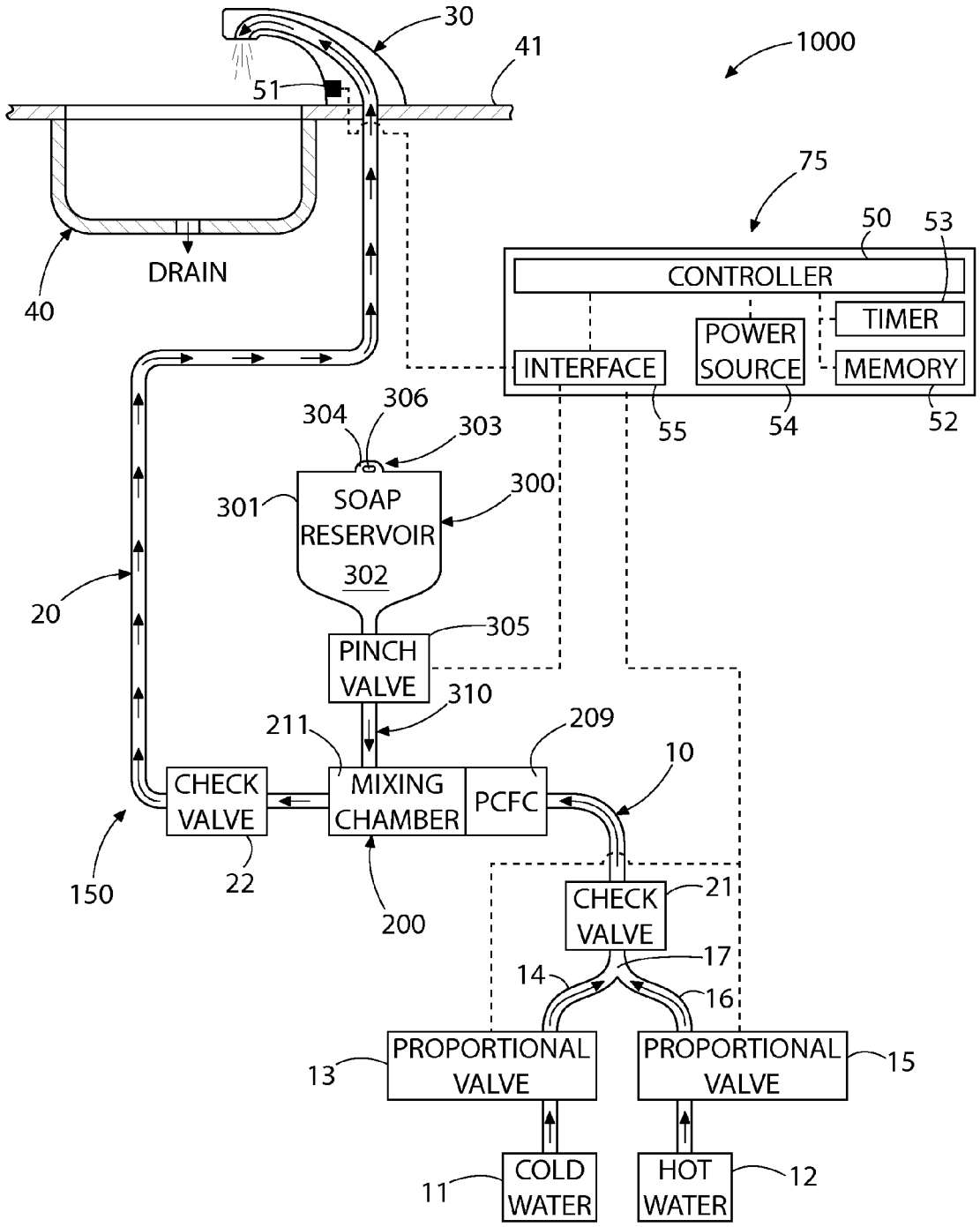
FIG. 1 is a diagrammatic representation of a dispensing system according to a first embodiment of the present invention.

The following description of embodiment(s) of the invention is merely exemplary in nature and is in no way intended, to limit the invention, its application, or uses. The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Referring first to FIG. 1, a dispensing system 1000 is illustrated according to an embodiment of the present invention. The dispensing system 1000 generally comprises a liquid supply circuit 150 and an electrical control circuit 75. The liquid, supply circuit 150 generally comprises, in fluid coupling, a water supply line 10, a mixing unit 200, a PCL reservoir 300, a PCL supply line 310, a dispensing line 20, a faucet. 30, and a washbasin 40.

The water supply line 10 is fluidly coupled, at an inlet end thereof, to a cold water source 11 and a hot water source 12. At an outlet end thereof, the water supply line 10 is fluidly coupled to the mixing, unit 200. Thus, during operation of the dispensing system 1000, the water supply line 10 supplies water to the mixing unit 200. A proportional valve 13 is operably coupled to the cold leg 14 of the water supply line 10 while a proportional valve 15 is operably coupled to the hot leg 16 of the water supply line 10. The proportional valves 13, 15 can be adjusted, for example by the user, to control the temperature of the water flowing, through liquid supply circuit 150 downstream of the convergence 17 of the cold and hot legs 14, 16, In the exemplified embodiment, the proportional valves 13, 15 are operably coupled to the electrical control circuit 75 so that, in response to user input, the controller 50 of the electrical control system 75 generates appropriate signals that are transmitted to the proportional valves 13 15. Upon receiving, said signals, the proportional valves 13, 15 adjust accordingly by either opening and/or closing the desired amount. For example, the user can interact with a no-touch sensor 51 of the electrical control system 75, which generates and transmits an activation signal to the controller 50, which in turn retrieves appropriate data from the memory 52 (and potentially activates the timer 53). The controller 50 then generates signals based on the retrieved data and transmits these signals to the proportional valves 13, 15 for action. In one embodiment of the invention, activation of the no-touch sensor 51 results in the controller 50 initiating a desired washing sequence, which includes, in sequential order: (1) a first supply of pure water to the faucet 30; (2) a supply of a mixture of water and PCL to the faucet 30 and (3) a second supply of pure water to the faucet 30.

The operable connections between the components 50-55 of the electrical control circuit 75, and the operable connections of said components 50-55 to the components 13, 15, 305 of the liquid supply circuit 150, are illustrated in the figures as dashed lines. Depending on the desired characteristics of the dispensing system 1000, the operable connections delineated in dashed lines can he wired connections, wireless connections or combinations of the wired and wireless. Of course, for wireless connections, appropriate transmitters, receivers and/or transceivers would he included as necessary.

While in the exemplified embodiment activation of water flow through the liquid supply circuit 150 is accomplished electronically as a result of a user activating the no-touch sensor 51, which can be for example an infrared sensor, the invention is not so limited. In other embodiments, the proportional valves 13, 15 can be manually actuated by the user. For example, in one such embodiment, the proportional valve 15 can be manually actuated by a user interacting with a hot water knob that is mounted above the countertop 41 adjacent the faucet 30 while the proportional valve 13 can be manually actuated by a user interacting with a cold water knob that is also mounted above the countertop 41 adjacent the faucet 30. In another such embodiment, a single tilt handle can be used to control both the proportional valves 13, 15 as is known in the art.

Figure 9:
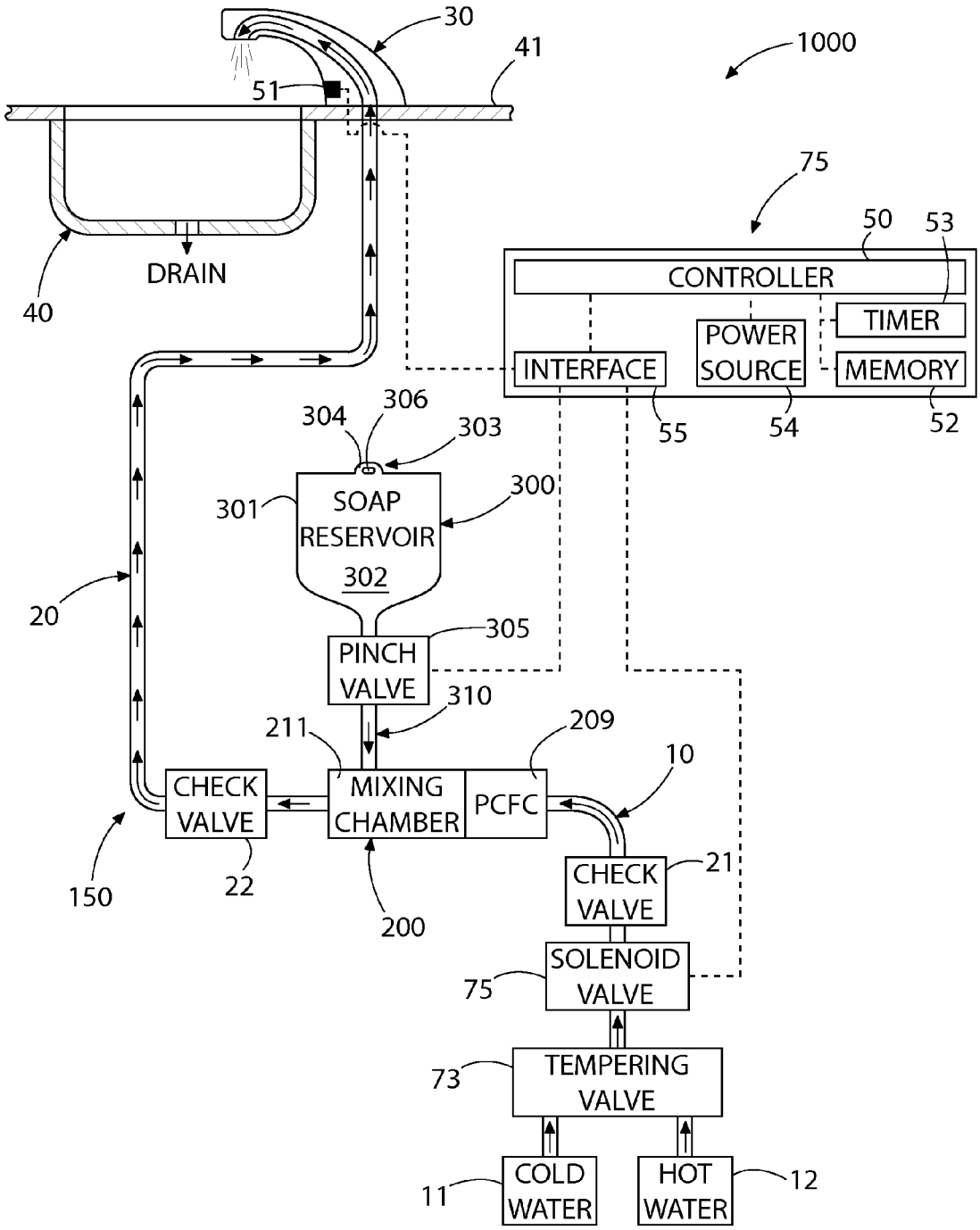
FIG. 9 is a diagrammatic representation of a modified version of the dispensing system of FIG. 1 in which the proportional valves have been replaced by a tempering valve and a solenoid valve.

In an even further embodiment, such as that which is shown in FIG. 9, the proportional valves 13, 15 can be replaced by a tempering valve 73 arid a solenoid valve 75. The tempering, valve 73, which may also be considered a thermostatic mixing valve in certain embodiments, is coupled to both the cold water source 11 and the hot water source 12 and is configured to blend the incoming hot and cold water streams to output a water stream having a fixed temperature.

This fixed temperature water stream is outputted to the water supply line 10 upstream of the solenoid valve 75. The solenoid valve 75, in certain embodiments, may be a simple "on/off" valve that controls whether the fixed temperature water stream exiting the tempering valve 73 reaches the mixing unit 200. The solenoid valve 75 is operably coupled to the electrical control circuit 75 so that, in response to user input, the controller 50 of the electrical control system 75 generates appropriate signals that are transmitted to the solenoid valve 75. Upon receiving said signals, the solenoid valve 75 is actuated accordingly to either turn the fixed temperature water flow "off" or "on" as desired, which as mentioned above may be in accordance with a desired washing sequence, which includes, in sequential order: (1) a first supply of pure water to the faucet 30; (2) a supply of a mixture of water and PCL to the faucet 30; and (3) a second supply of pure water to the faucet 30.

Referring again to FIG. 1, a pinch valve 305 is operably coupled to the PCL supply line 310. As will be described in greater detail below, the pinch valve 305 can be selectively actuated between an open state and a closed suite to control the supply of PCL from the PCL reservoir 300 to the mixing unit 200. In one embodiment, the pinch valve 305 is operably coupled to the controller 50 and is, thus, electrically controlled in accordance with a preprogrammed sequence stored in the memory 52 in another embodiment, the pinch valve 305 may be a water pressure activated valve, or can be replaced by a water pressure activated valve that is not of the "pinch" type.

The PCL reservoir 300 comprises a container 301 which is at least partially filled with a volume of PCL 302, The container 301, in one embodiment, is collapsible so as to accommodate the loss of PCL 302 from the container 301 without producing negative pressure build-up therein. In one such embodiment, the container 301 may be a flexible bag or another bladder-type sack. In other such embodiments, the container 301 may simply comprise a sufficiently deformable or translatable wall, such as a piston-like wall. In other embodiments, however, the container 301 may not be collapsible but may rather include one-way pressure relief valve that allows air to enter the container 301 to eliminate negative pressure build-up therein.

The PCL 302 can be any type of personal care product, such as those used for cleaning, treating and/or washing a person. Examples of PCL 302 that can be used in the dispensing system 1000 include, without limitation, such as soap, shampoo, antibacterial liquids, disinfectant liquids, liquid dishwashing detergents, other sanitization fluids, and/or combinations thereof in certain embodiments, the PCL 302 is engineered and/or selected to have a viscosity (at ambient temperature) that achieves desired fluid flow criteria with respect to introducing the PCL 302 in the water flow in the mixing chamber 200 (discussed in greater detail below).

In the exemplified embodiment, the PCL container 301 also comprises a mounting feature 303 that allows the PCL container to be hung or otherwise mounted to a structure so that gravity-induced flow of the PCL 302 from the PCL reservoir 300 into the PCL supply line 310 is achieved. In the exemplified embodiment, the mounting feature is a tab 304 having a hole 306. In one embodiment, the tab 304 is integrally formed with the flexible bag that forms the PCL container 301. Of course, other mounting features 303 are envisioned, including, without limitation, a bar, a block, a bracket, a plug, a hook, a tab, or combinations thereof.

As will be discussed greater detail below, the PCL reservoir 300 and the PCL supply line 310 are intended to be replaceable such that upon depletion of the PCL 302 from the PCL reservoir 300, the entire assembly of the PCL reservoir 300 and the PCL supply line 310 are removed from the dispensing system 1000 and replaced with a new assembly (i.e., a refill) of a PCL reservoir 300 and a PCL supply line 310. While in certain embodiments only the PCL reservoir 300 may be replaceable, it is desirable in the exemplified embodiment that the entire assembly of the PCL reservoir 300 and the PCL supply line 310 be replaceable due to the pinch valve 305 acting on the PCL supply line 310 (discussed in greater detail below).

The PCL supply line 310 fluidly couples the PCL reservoir 300 to the mixing unit 200 so that PCL 302 can be introduced into the water stream flowing through the mixing unit 200 that was introduced by the water supply line 10 (which will be described below in greater detail). As a result of the PCL 302 being introduced into the water stream flowing though the mixing device 200, a mixture of PCL and water is formed in the mixing unit 200 and is discharged to the dispensing line 20. The dispensing line 20 fluidly couples the mixing device 200 to the faucet 30, thereby delivering the subject fluid, whether it be pure water or the mixture of water and PCL, to the end user at a position above the washbasin 40.

The dispensing system 1000 also comprises a plurality of check valves 21, 22 operably coupled to the liquid supply circuit 75 at strategic locations to prevent the backflow, such as the backflow of the mixture of water and PCL. In the exemplified embodiment, a first check valve 21 is operably coupled to the water supply line 10 upstream of the mixing unit 200 and downstream of the hot and cold water convergence 17. In order to minimize the amount of the mixture of water and PCL in the liquid supply circuit 150 at any given time, in certain embodiments, the first check valve 21 may be located immediately adjacent the mixer 200 and upstream thereof. The exemplified embodiment further comprises a second check valve 22 downstream of the mixing unit 200 and downstream of the faucet 30. Any type of suitable check valve known in the art can be used as the check valves 21, 22, including without limitation, a ball check valve, a diaphragm check valve, a stop-check valve, a lift-check valve, an inline check valve, or a duckbill valve.

While not exemplified, a third check valve may be provided within the PO. supply line 310 downstream of the pinch valve 301 and upstream of the mixing unit 200 to prevent water that is flowing through the mixing unit 200 from entering the PCL reservoir 300 and the PCL supply line 310. Any of the aforementioned types of check valves can be utilized for the third check valve. In one embodiment, however, the third check valve will be a duckbill valve.

Figure 2:
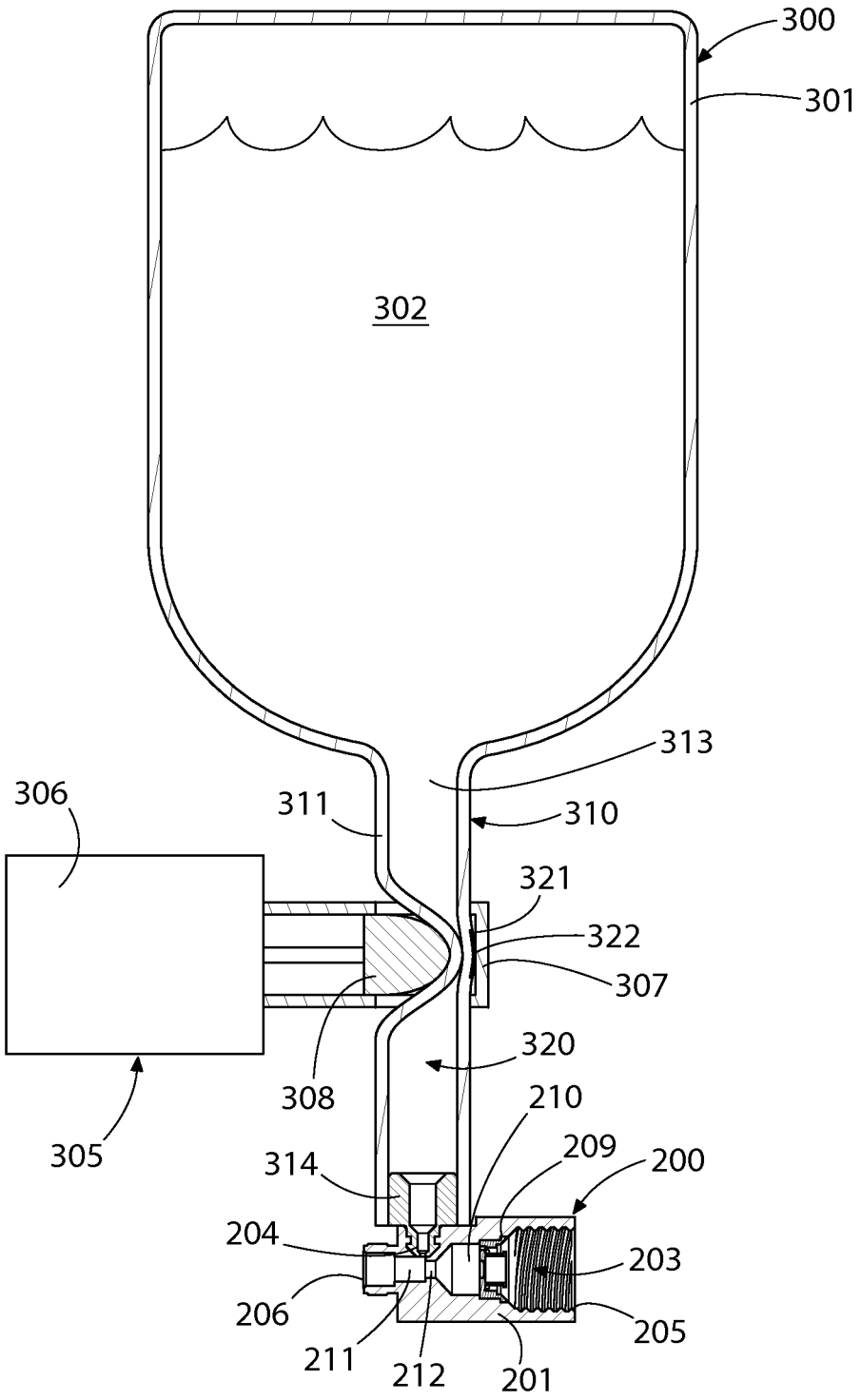
FIG. 2 is a schematic of the personal care liquid (PCL) reservoir fluidly coupled to the mixing unit of the dispensing system of FIG. 1 by a PCL supply line.
Figure 3:
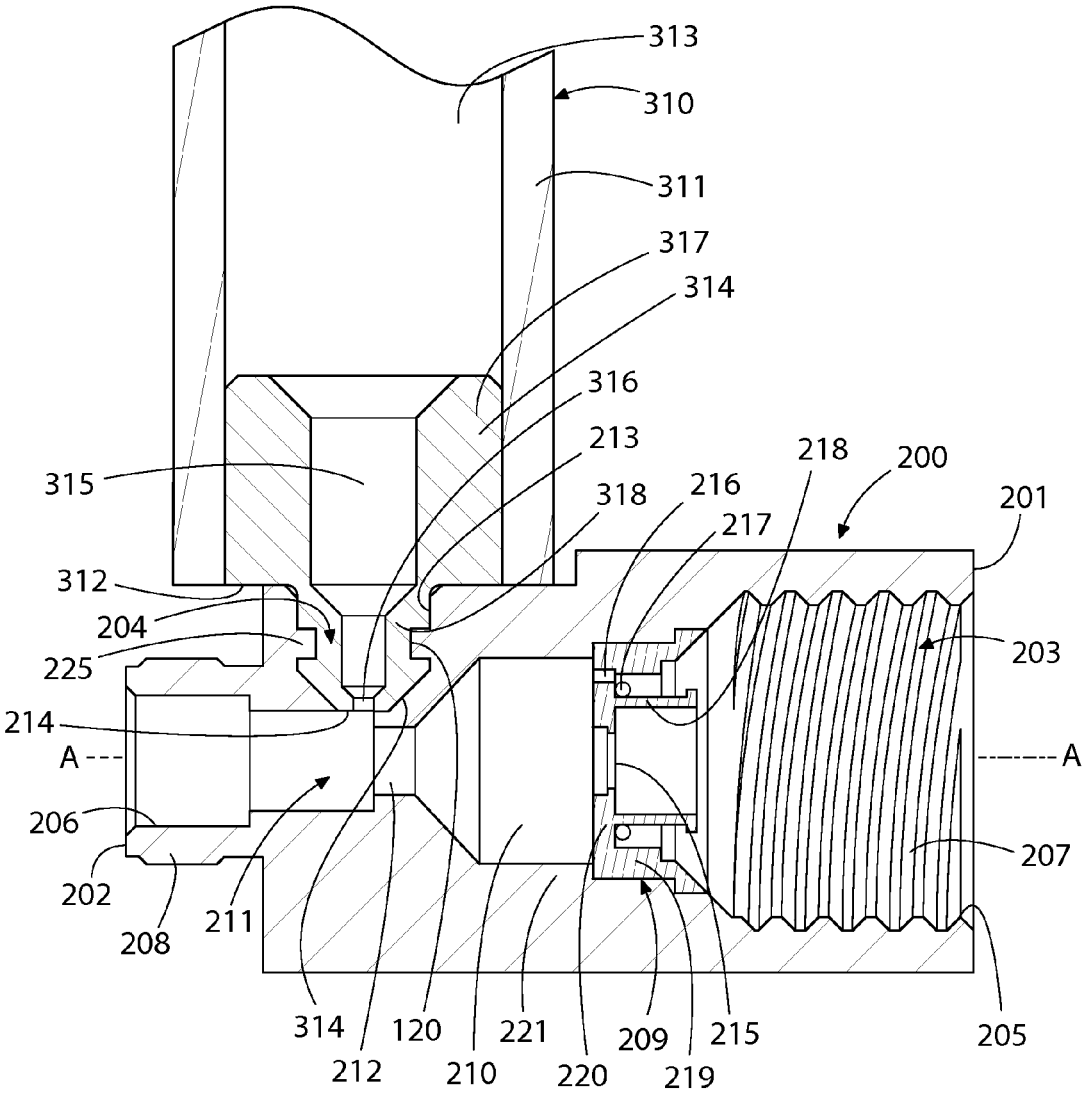
FIG. 3 is a close-up view of the mixing unit arid the PCL supply line fluidly coupled thereto, according to an embodiment of the present invention.

Referring now to FIGS. 2 and 3 concurrently, details of the mixing unit 200, the supply of PCL 302 to the mixing valve, and the operation thereof will be discussed in greater detail. The mixing unit 200 generally comprises a body 201 extending from a first end 202 to a second end 203 along a longitudinal axis A-A. In the exemplified embodiment, the longitudinal axis A-A is substantially horizontal. In another embodiment, however, the longitudinal axis A-A is substantially vertical. In yet another embodiment, the longitudinal axis A-A is obliquely oriented to the horizon.

The body 201 comprises a first passageway 203 and a second passageway 204 In the exemplified embodiment, the first passageway 203 extends along the longitudinal axis A-A and is substantially parallel therewith while the second passageway 204 extends substantially perpendicular to the longitudinal axis A-A. In another embodiment, the first passageway 203 extends along, the longitudinal axis A-A and is substantially parallel therewith while the second passageway 204 extends obliquely to the longitudinal axis A-A. The first passageway extends from a water inlet 205 to an outlet 206. When incorporated into the dispensing system 1000, the water inlet 205 is fluidly coupled to the water supply line 10 while the outlet 206 in fluidly coupled to the dispensing line 20.

In the exemplified embodiment, the water inlet 205 comprises a threaded section 207 that allows the mixing unit 200 to be threadily coupled to the water supply line 10. In other embodiments, the water inlet 205 can comprise a plug, a socket, a rib, tangs, dimples, or other features that allow and/or facilitate fluid coupling of the mixing unit to the water supply line 10. The outlet 206 comprises a quick-fit plug 208 that allows and/or facilitates fluid coupling of the mixing unit 200 to the dispensing line 20. In other embodiments, the outlet 206 can comprise a threaded section, a socket, a rib, tangs, dimples, or other features that allow and/or facilitate fluid coupling of the mixing unit 200 to the dispensing line 20. It should be noted that, as used throughout this application, when it is said that one component is fluidly coupled to another component, intermediate components or lines may he present between said one component and said other component.

Between the water inlet 205 and the outlet 206, the first passageway 203 comprises, in order of upstream to downstream, a pressure compensating flow control (PCFC) device 209, a pressure compensated chamber 210, and a mixing, chamber 211 that comprises a venturi constriction 212. Thus, the PCFC device 209 is operably disposed in the first passageway 203 between the venturi constriction 212 and the water inlet 205.

The second passageway 204 extends from a PCL inlet 213 to a PCL outlet 214 that is located in the mixing chamber 211. The PCL supply line 310 is fluidly coupled to the PCL inlet 213. More specifically, the PCL inlet 213 is configured so that the PCL supply line 310 can be detachably coupled to the mixing unit 200 via the PCL inlet 213. In the exemplified embodiment, this is achieved by shaping the PCL inlet 213 in the form of socket that corresponds with a plug 314 of the PCL supply line 310 to effectuate a fluid-tight mating therebetween via an interference fit (discussed in greater detail below).

When water is flowing through the first passageway 203, the venturi constriction 212 in the mixing chamber 211 creates the desired venturi effect. Specifically, due to the venturi constriction 212, a zone of low pressure (and high velocity) is created in the water stream at (and adjacent to) the venturi construction 212, including at the area in the mixing chamber 211 at which the PCL outlet 214 is located. Thus, by properly locating PCL outlet 214 within the venturi induced, low pressure zone, available PCL 302 in the PCL supply line 310 will be drawn into and mixed in the water stream as the water stream flows through the mixing chamber 211, thereby creating a mixture of water and PCL that exits the mixing unit 200.

In certain embodiments, it is desired that the PCL 302 be drawn into the mixing chamber 211 (via the venturi effect) in a predictable, consistent and reproducible manner despite variations in the water pressure upstream of the mixing unit 200. This is accomplished by the inclusion of the PCFC device 209 in the mixing unit 200. The PCFC device 209 maintains a substantially constant flow rate of water through the venturi constriction 212 despite (and during) fluctuations in water pressure upstream of the PCFC device 209. This is accomplished, in certain embodiments, by the PCFC device 209 comprising a restriction, the size of the effective cross-sectional area of which is variable in response to variations in water pressure upstream of the PCFC device 209 (also known as a variable restriction).

In the exemplified embodiment, the PCFC device 209 comprises an annular body 219. The PCFC device 209 is positioned within the first passageway 203 so that the annular body 209 is in abutment with an annular shoulder 221 of the body 201. Thus, the annular shoulder 221 assists in axially retaining the PCFC device 209 in position within the mixing unit 200.

The annular body 219 comprises an annular collar 218 and an annular wall portion 220 extending radially from and circumferentially surrounding the annular collar 218. A central passageway 215 is provided in the annular collar 218 and a plurality of spaced-apart outer passageways 216 (one of which is visible) are provided in the annular wall portion 220. The central passageway 215 and the plurality of spaced-apart outer passageways 216 extend longitudinally through the annular body 219 and, thus, collectively form what is considered the variable restriction of the PCFC device 209. The effective cross-sectional area of the variable restriction is varied h a restricting element 217 that responds to mechanical force directly imparted on the restricting element 217 by the water (i.e., the water pressure) upstream of the PCFC device 209 to vary the size of effective cross-sectional area of the restriction. In the exemplified embodiment, the restricting element 217 is a resilient O-ring that is fitted about the annular collar 218. When subjected to low water pressure upstream of the PCFC device 209, the restricting element 217 does not block or otherwise impede water flow through the plurality of spaced-apart outer passageways 216. Thus, the variable restriction is wide open. However, when the water pressure upstream of the PCFC device 209 increases, the restricting element 217 is forced against the annular wall portion 220 where it can block one or more (or portions) of the plurality of spaced-apart outer passageways 216, thereby reducing the effective cross-sectional area of the variable restriction. As the water pressure upstream of the PCFC device 209 continues to increase, the restricting element 217 can be flattened out (and/or diametrically expanded) to completely block the plurality of spaced-apart outer passageways 216, thereby further reducing the effective cross-sectional area of the variable restriction. As a result, the water can flow only through the central passageway 215 where the increased velocity results in reduced pressure downstream of the PCFC device 209 in the pressure compensated chamber 210.

While one embodiment of a PCFC device is illustrated, many variations of pressure compensating flow control devices are available in the art and can be used as the PCFC device 209. For example, suitable PCFC devices include those that are commonly found in aspirating shower heads.

Referring still to FIGS. 2 and 3 concurrently, the PCL supply line 310 fluidly couples the PCL reservoir 300 to the mixing unit 200. The PCL supply line 310 comprises a resilient conduit 311 that forms an internal passageway 313 extending from the internal volume of the container 101 to the mixing chamber 211 in the exemplified embodiment, the resilient conduit 311 and the container 301 are integrally formed or fixed together to form a replaceable unit. The resilient conduit 311 can be compressed (for example by closing the pinch valve 305) to seal the internal passageway 313. Upon cessation of the compression force (for example by opening the pinch valve 305), the resilient conduit 311 returns to its non-deformed shape so that the internal passageway 313 is once again open so that PCL 302 can flow therethrough.

The resilient conduit 312 comprises a free end 312. The free end 312 is configured to be detachably coupled to the PCL inlet 213 of the mixing unit 200 for easy and quick coupling and uncoupling during replacement of the assembly of the PCL reservoir 300 and PCL supply line 310 upon the PCL 302 being depleted. In the exemplified embodiment, this is accomplished by the free end 312 comprising a resilient plug 314. The resilient plug 314 comprises a PCL delivery passageway 315 that terminates in a metered orifice 316. The plug 314 is insertable into the socket formed by the PCL inlet 213 of the mixing unit 200 to form a fluid-tight fit that can be easily coupled and uncoupled by simply pulling on the resilient conduit 311. When the plug 314 is disposed within the socket formed by the PCL inlet 213, the metered orifice 316 forms the PCL outlet 214 of the second passageway 204.

The plug 314 comprises a body portion 317 that is disposed within the internal passageway 313 of the resilient conduit 311 and a protruding portion 318 extending, from the internal passageway 313. When the plug 314 is detachably coupled to the PCL inlet 213 of the mixing unit 200, the PCL passageway 315 of the plug 314 fluidly couples the internal passageway 313 of the resilient conduit to the mixing chamber 211 of the mixing unit 200. It should he noted, however, that in certain instances the PCL passageway 315 can be conceptually considered to be part of the internal passageway 313. The protruding portion 318 of the plug 314 comprises a tapered end 319 and an annular groove 320 formed into the outer surface of the protruding portion 318. The annular groove 320 is located adjacent the tapered end 319 and provides a nesting feature that can receive an annular flange 225 formed in a sidewall of the second passageway 204.

When the protruding portion 318 of the plug 314 is pressed into the socket of the PCL inlet 213, the tapered end 319 compresses as it slides over the annular flange 225. Upon the tapered end 318 of the plug passing the annular flange 225 of the mixing unit 200, the annular flange 225 nests in the annular groove and the tapered end 319 resumes its shape. The mating between the annular flange 225 of the mixing unit and the annular groove 320 of the plug 314 creates an interference fit that secures the PCL supply line 310 to the mixing unit 200. In the exemplified embodiment, the resilient conduit 311 comprises the plug 314 while the PCL inlet 213 of the mixing unit 200 comprises the corresponding socket. In another embodiment, however, the resilient conduit 311 may comprise the socket while the PCL inlet 213 of the mixing unit 200 comprises the corresponding plug. In still other embodiments, other structurally cooperative features can be used to effectuate the detachable coupling of the PCL supply line 310 to the mixing unit 200. For example, in certain other embodiments, a clamp/plug arrangement, a threaded connection, a tang/notch mating arrangement, a tight-fit assembly, and/or other connection techniques may be used instead of or in addition to the exemplified plug/socket arrangement.

A pinch valve 305 is operably coupled to the resilient conduit 311. The pinch valve 305, in the exemplified embodiment, is an electrically actuated pinch valve that is controlled by the controller 50. The pinch valve 305 comprises a housing 306 that houses the required electrical components and a bracket 307 coupled to the housing 306. The bracket 307 may be a U-shaped, L-shaped or C-shaped bracket through which the resilient tube 311 extends. The bracket 307 provides a stop against which the resilient conduit 311 can be compressed by the piston 308. in other embodiments, however, the bracket may be omitted and another structure or wall can be used as the stop.

The pinch valve 305 is actuatable between: (1) a closed position in which the pinch valve 305 compresses the resilient conduit 311 at a first location 322 to seal the internal passageway 313 of the resilient conduit 31.1 (shown in FIGS. 2); and (2) an open position in which the pinch valve 305 does not compress the resilient, conduit 311 so that PCL 302 can freely flow through the internal passageway 313 of the resilient conduit 311. The first location 322 can be selected so that the internal passageway 313 comprises a metered volume 320 between the first location 322 of the resilient conduit 311 and the metered orifice 316. The metered volume 320 corresponds to a predetermined single-use dosage of the PCL 302 that is desired to be introduced into the water stream in the mixing unit 200 during a washing session. The metered volume 320 can be controlled by adjusting the length of the resilient conduit 311 that exits between the first location 322 and the metered orifice 316 and/or by adjusting the diameter of the internal passageway 313. As will be discussed below, in certain embodiment of the invention the pinch valve 305 is in the closed state during flow of water through the mixing unit 200. When this is the case. only the PCL 302 in the metered volume 320 can be drawn into the mixing chamber 311 by the venturi effect, thereby allowing the dosage of the PCL 302 into the water stream to precisely and simply controlled.

To this end, the first location 322 of the resilient conduit 311 may comprise a visual indicia 321 thereon so that the resilient conduit 311 can be properly positioned during loading of the assembly of the PCL reservoir 300 and the PCL supply line 310 into the dispensing system 1000. More specifically, the visual indicia 321 (which is generically illustrated as a black rectangle) provides the user with a visual cue as to what portion of the resilient conduit 311 should be aligned with the pinch valve 305. The visual indicia 321 can take the form of a colored or scored stripe, alphanumeric sequence, "X" mark or graphical symbol. In other embodiments, the visual indicia 321 can be a piece of tape, a sleeve, or a colored portion of the resilient tube 311. Of course, the aforementioned listing is not exhaustive.

When the pinch valve 305 is in the open state, a gravity driven flow of PCL 302 from the PCL reservoir 300 will fill (or replenish) the metered volume 320 in certain embodiments of the invention. Moreover, in certain embodiments, the size of the metered orifice 316 and the viscosity of the PCL 302 are selected so that the PCL 302 does not flow through the metered orifice 316 absent a venturi effect being created in the mixing chamber 311. In another embodiment, the size of the metered orifice 316 and the viscosity of the PCL 302 are selected so that the PCL 302 does not leak through the metered orifice 316 under the force of gravity.

In one embodiment, the dispensing system 1000 is free of any pump that forces PCL 302 into the mixing chamber 311. Rather, introduction of the PCL 302 into the mixing chamber 311 is the sole result of the venturi effect caused by the venturi constriction 312 and/or gravity.

In certain embodiments, the resilient conduit 311 may comprise a pre-weakened portion at the first location 322 so that compression of the resilient conduit 311 is more easily achieved by the pinch valve 305. For example, the pre-weakened portion can be achieved by creating a thinned section of the resilient conduit 311 at the first location 322. In other embodiments, the pre-weakened portion can be created by pre-fatiguing the resilient conduit to certain extent or by creating shallow scores in the resilient conduit 311.

Through proper control of the pinch valve 305, the amount of (and duration that) the PCL 302 is introduced into the water stream in the mixing unit 200 can be controlled. Thus, the pinch valve 305 can be controlled to ensure that only a desired amount of PCL 302 is provided during one washing session. Moreover, control of the pinch valve 305 can be utilized so that the following dispensing sequence can be easily achieved: (1) pure water; (2) a mixture of water and PCL 302; and (3) pure water In one embodiment of the dispensing system 1000, the controller 50 is configured to: (1) actuate the pinch valve 305 into the closed state upon flow of water through the liquid supply circuit 150 being activated; and (2) actuate the pinch valve 305 into the open state upon flow of water through the liquid supply circuit 150 being terminated.

In another embodiment of the dispensing system 1000, the controller 50 is configured to: (1) activate flow of water by activating the proportional valves 13, 15 in response to a signal received by the no-touch sensor 51; (2) actuate the pinch valve 305 from the closed state to the open state and activate the timer 53; and (3) upon expiration of the timer 53, actuate the pinch valve 305 from the open state to the closed state. In such an embodiment, the timer 53 is set for a predetermined period of time corresponding to a predetermined volume of the PCL 302 being introduced into the flow of water in the mixing chamber 211. In such an embodiment, the metered volume 320 can be omitted.

Figure 4:
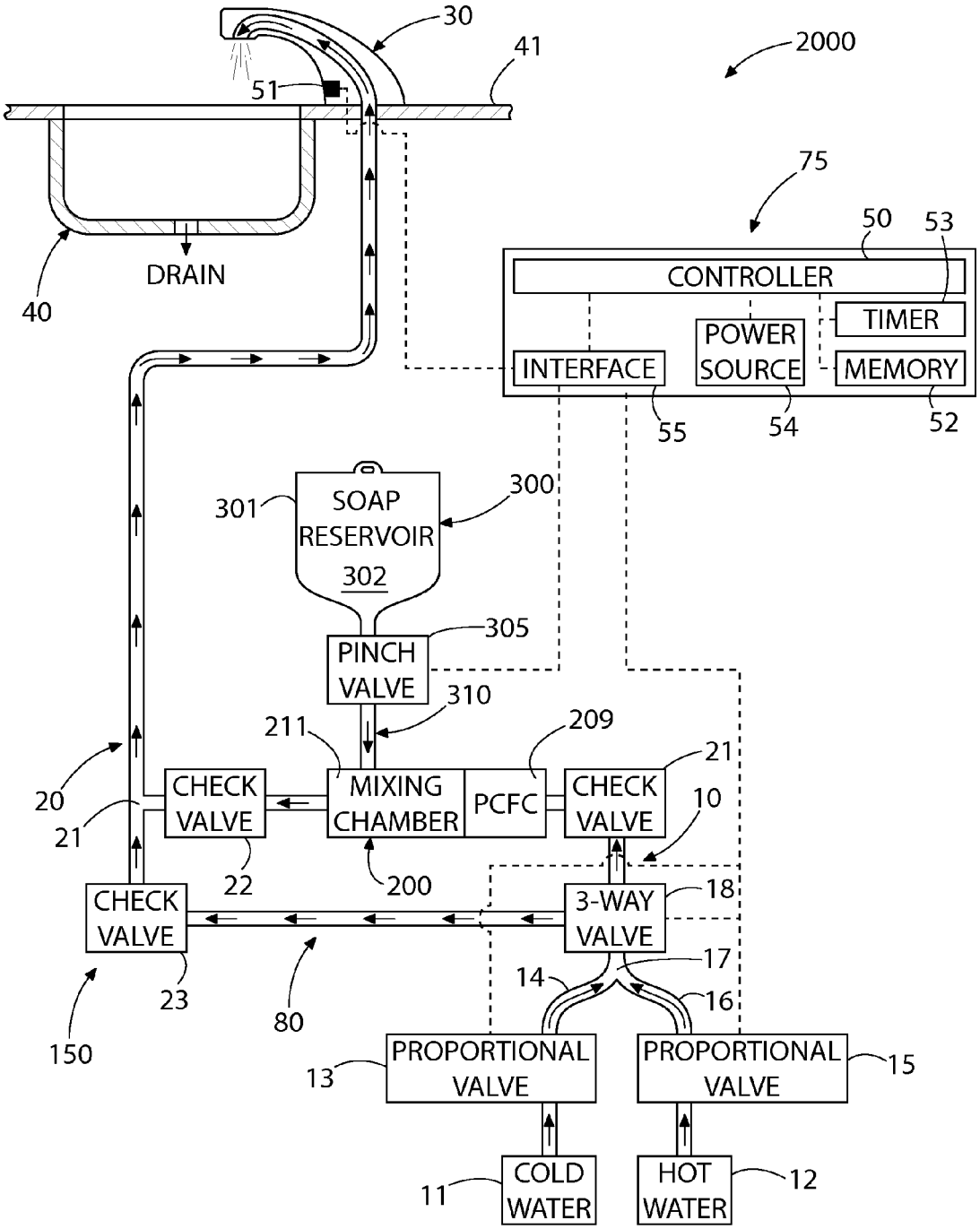
FIG. 4 is a diagrammatic representation of a dispensing system according to a second embodiment of the present invention in which a bypass line and three way valve is included so that the mixing unit can be selectively bypassed.

Referring now to FIG. 4, a dispensing system 2000 according to a second embodiment of the present invention is illustrated. The dispensing system 2000 is substantially identical to the dispensing 1000 described above with the exception that a three way valve 18 has been operably coupled to the water supply line 10 and a bypass line 80 has been operably coupled to the three way valve, and fluidly coupled to the dispensing line 20. In order to avoid redundancy, only those aspects of the dispensing system 2000 that differ from the dispensing system 1000 will be discussed with the understanding that the remaining portions thereof are the same.

The three way valve 18 is operably coupled to the water supply line 10 downstream of the hot and cold water convergence 17 and upstream of the mixing device 200. The bypass Ink 80 is operably coupled to the three way valve 18 and fluidly coupled to the dispensing line 20. The three way valve 18 is actuatable between: (1) a first state in which water flow is directed through mixing unit 200 and prohibited from flowing through the bypass line 80; and (2) a second state in which water flow is directed through the bypass line 80 and prohibited from flowing through the mixing unit 200. The controller 50 is operably coupled to the three-way valve 18, As such, the three way valve 18 can be selectively actuated by the controller 50 between the first and second states to drop the mixing unit 200 in and out of the liquid supply that is provided to the faucet 30.

More specifically, when the three way valve 18 is in the first state, water is supplied to the mixing unit 200 where PCL 302 is introduced into the water stream to create the mixture of water and PCL, which is then supplied to the dispensing line 20 and eventually to the faucet 30. However, when the three way valve 18 is in the second state, the water is supplied to the bypass line 80 where it then enters the dispensing line 20 and is dispensed from the faucet 30 as pure water. Thus, in this embodiment, the dispensing system 2000 can control the amount of PCL introduced into the water (and the duration that the mixture of water and PCL is dispensed by the faucet) by simply actuating the three way valve 18. Thus, in this embodiment, the pinch valve 305 is not necessary but may be provided as a fad-safe it desired.

The dispensing line 20 comprises a flow convergence zone 21 where the bypass line 80 and the line exiting the mixing unit 200 meet. Again, the second check valve 22 is operably coupled downstream of the mixing chamber 200 and upstream of the flow convergence zone 21. A third check valve 23 is also operably coupled downstream of the three way valve 18 and upstream of the flow convergence zone 21.

In one embodiment of the dispensing system 2000, the controller 50 is configured to carry out the following washing sequence: (1) activate flow of water; (2) actuate the three way valve 18 from the second state to the first state (if necessary) and activate the timer 53; and (3) upon expiration of the timer 53, actuate the three way valve 18 from the first state to the second state. During step (1), pure water is dispensed via, the faucet 30. During step (2), the mixture of water and PCL is dispensed form the faucet 30. During step (3), pure water is again dispensed from the faucet 30. Step (1) can be performed for a predetermined period of time to allow for initial wetting of one's hands. Moreover, subsequent to step (3), water can continue to be supplied for a predetermined period of time to allow for rinsing. For step (2), the timer 53 may be set for a predetermined period of time corresponding to a predetermined volume of PCL 302 being: introduced into said flow of water in the mixing chamber 211.

Referring now to FIGS. 5-8B concurrently, a dispensing system 3000 according to a third embodiment of the present invention will be discussed. The dispensing system 3000 is substantially identical to the dispensing, 1000 described above with the exception that a valve unit 400 comprising a normally open water pressure activated valve 401 and a normally closed water pressure activated valve 402 has replaced the pinch valve 305 to control/meter the flow of the PCL 302 into the mixing unit 200. In order to avoid redundancy, only those aspects of the dispensing system 3000 that differ from the dispensing system 1000 will be discussed with the understanding; that the remaining portions thereof are the same, The valve unit 400 comprises a valve line 403 that, in the exemplified embodiment, is fluidly coupled to the outlet 206 of the first passageway 203 of the mixing unit 200 (i.e., downstream of the mixing unit 200). In another embodiment, the valve line 403 may be fluidly coupled to the water inlet 205 of the first passageway 203 of the mixing unit 200 (i.e., upstream of the mixing unit 200). The normally closed water pressure activated valve 402 is operably coupled to the valve line 403 to be actuatable between: (1) a closed state (FIG. 8A) in which the normally closed water pressure activated valve 402 seals the PCL supply line 310 at a first location 370; and (2) an open state (FIG. 8B) in which the PCL supply line 310 is open at the first location 370. The normally open water pressure activated valve 401 is operably coupled to the valve line 403 to be actuatable between: (1) an open state (FIG. 7A) in which the PCL supply line 310 is open at a second location 371; and (2) a closed state (FIG. 7B) in which the normally open water pressure activated valve 401 seals the PCL supply line 310 at the second location 371.

Figure 7A:
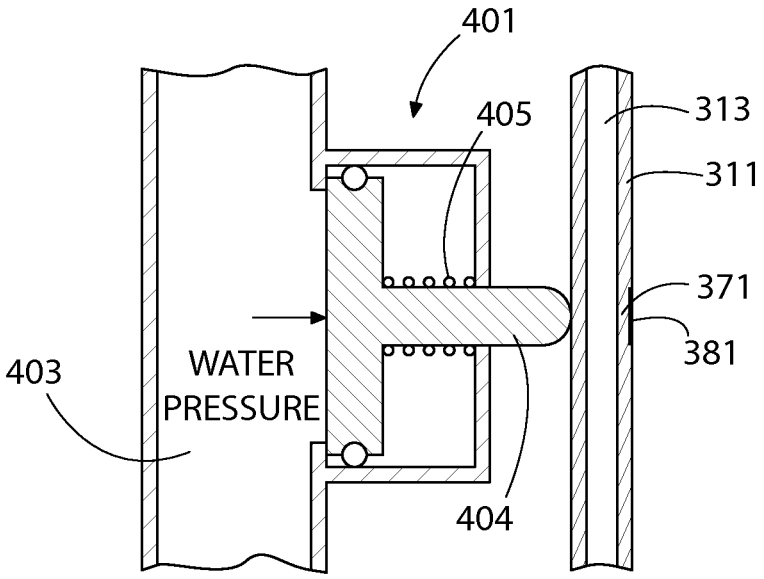
FIG. 7A is a schematic of the normally open water pressure activated valve of the valve unit in the dispensing system of FIG. 5, in which the normally open water pressure activated valve is in an open state.
Figure 7B:
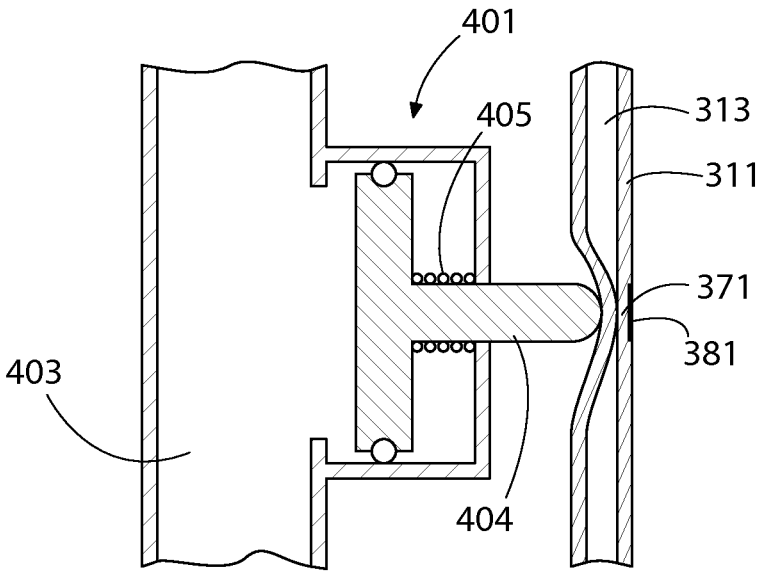
FIG. 7B is a schematic of the normally open water pressure activated valve of FIG. 7A, in which water pressure in the valve line has actuated the normally open water pressure activated valve to a closed state.

Water pressure of water flowing through the valve line 403 actuates the normally closed water pressure activated valve 402 from the closed state (FIG. 8A) into the open state (FIG. 8B) and actuates the normally open water pressure activated valve 401 from the open state (FIG. 7A) into the closed state (FIG. 7B). More specifically, as the water flow through the liquid supply circuit 150 is activated, water flows into the valve line 403, thus resulting in an increase in water pressure within the valve line.

Regarding operation of the normally open water pressure activated valve 401, the increased water pressure in the valve line 403 acts on the piston 404, thereby overcoming the spring force of the spring 405 and translating the piston 405 so that the end of the piston 404 contacts and compresses the resilient conduit 311 of the PCL supply line 310 at the second location 371 (see FIGS. 7A and 713). As a result, the internal passageway 313 of the resilient conduit 311 becomes sealed at the second location 371. An O-ring 408 (or other gasket) is provided about the piston 404 to maintain the fluid-tight nature of the valve line 403 during said translation.

Figure 8A:
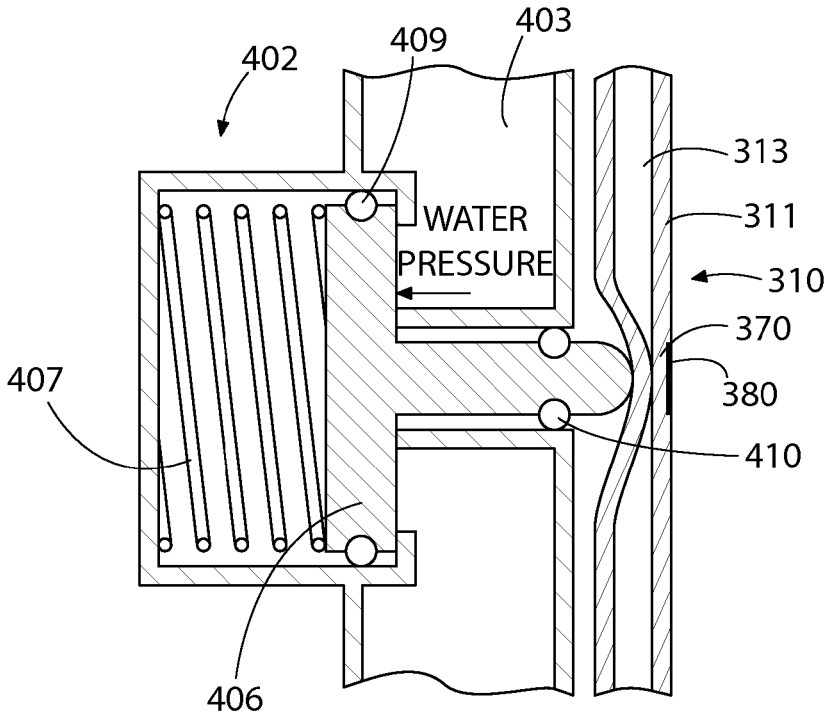
FIG. 8A is a schematic of the normally closed water pressure activated valve of the valve unit in the dispensing system of FIG. 5, in which the normally closed water pressure activated valve is in a closed state.
Figure 8B:
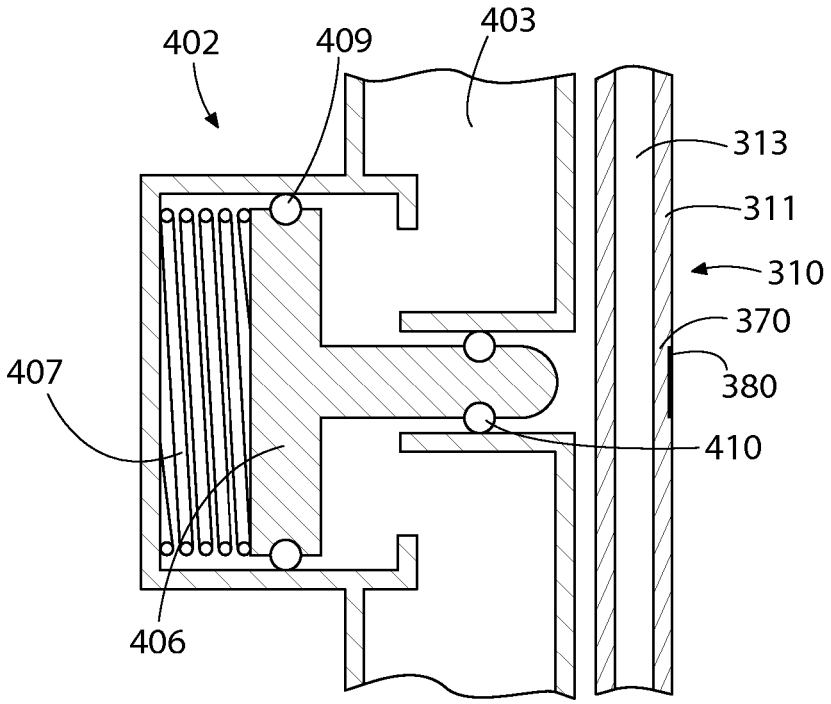
FIG. 8B is a schematic of the normally closed water pressure activated valve of FIG. 8A, in which water pressure in the valve line has actuated the normally closed water pressure activated valve to an open state.

Meanwhile, the increased water pressure in the valve line 403 also acts on the piston 406 of the normally closed water pressure activated valve 402, thereby overcoming the spring force of the spring 407 and translating the piston 406 so that the end of the piston 406 is drawn away from the resilient conduit 311 of the PCL supply line 310 so that compression (and sealing) at the first location 370 is eliminated (see FIGS. 8A and 8B). Thus, the PCL can then flow through the internal passageway 313 of the resilient conduit 311 at the first location 371. O-rings 409-410 (or other gaskets) are provided about the piston 406 to maintain the fluid-tight nature of the valve line 403 during said translation.

The second location 371 is upstream of the first location 370. Similar to that which is discussed above for the dispensing system 1000, a metered volume 320 is defined in the internal passageway 313 between the second location 371 and the first location 370. In one embodiment, the metered volume 320 corresponds to a predetermined single-use dosage of the PCL 302 that is desired to be introduced into the water stream in the mixing unit 200 during a washing session. The metered volume 320 can be controlled by adjusting the length of the resilient conduit 311 that exits between the first and second locations 370, 371 and/or by adjusting the diameter of the internal passageway 313.

Figure 5:
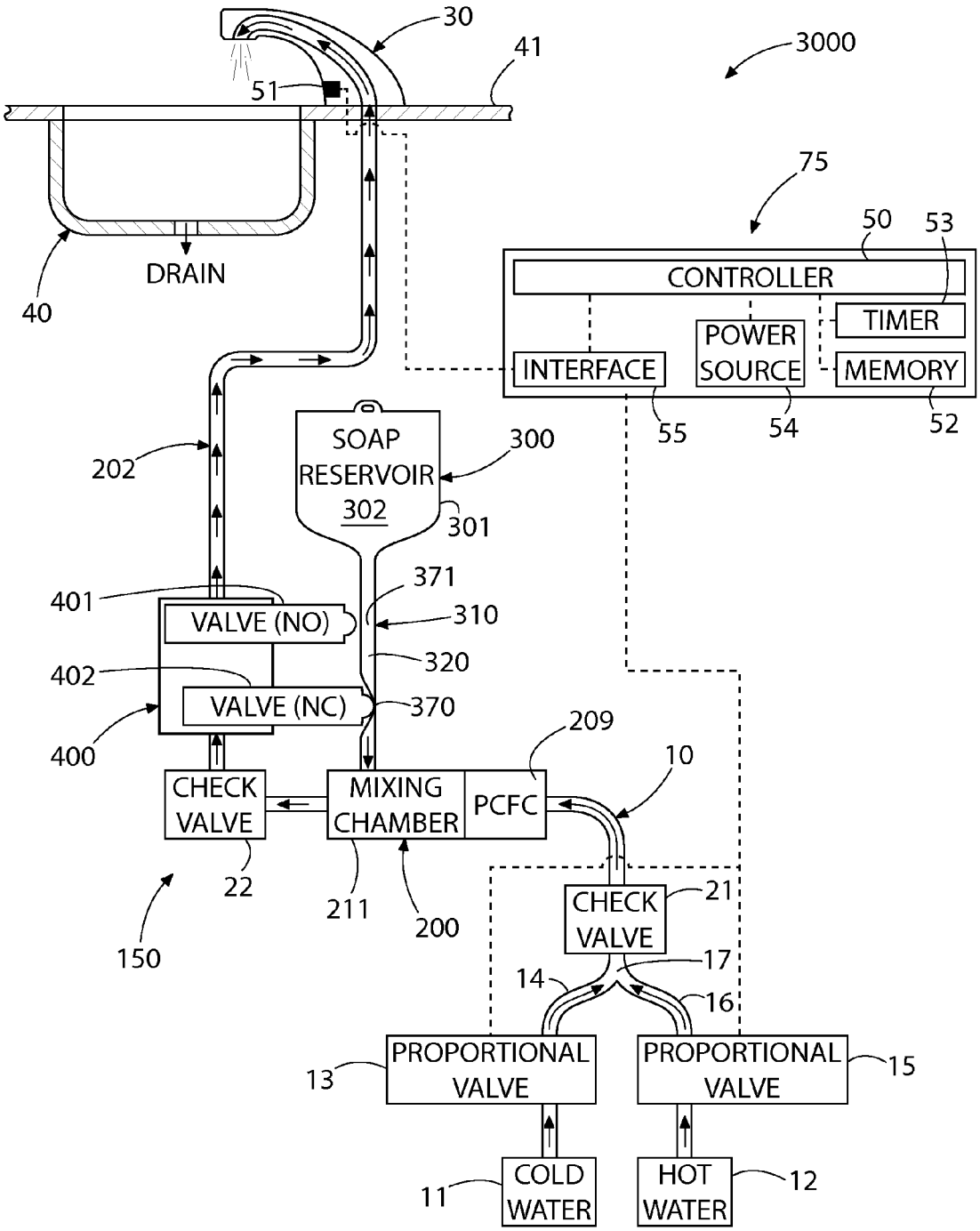
FIG. 5 is a diagrammatic representation of a dispensing system according, to a third embodiment of the present invention, wherein a valve unit comprising a normally open water pressure activated valve and a normally closed water pressure activated valve is included to control supply of the PCL to the mixing unit.
Figure 6:
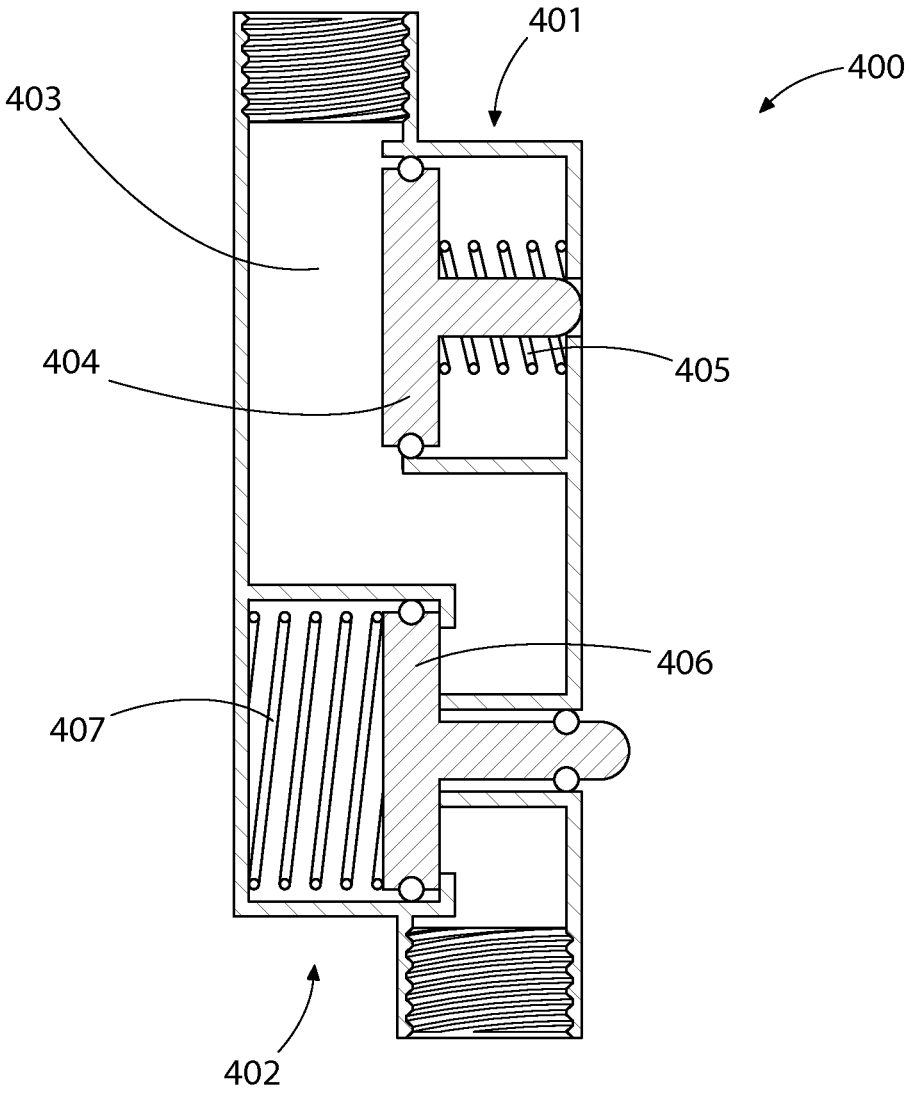
FIG. 6 is a schematic of the valve unit of the dispensing system of FIG. 5, according to an embodiment of the present invention.

As should be apparent from the above-discussion when water flow is not activated through the liquid supply circuit 150, there is no substantial water pressure in the valve line 403. As a result, the normally open water pressure activated valve 401 is in the open state while the normally closed water pressure activated valve 402 is in the closed state (as shown in FIG. 5). Thus, the PCL 302 within the PCL reservoir 300 will flow, via gravity induction, into the PCL supply line 10 and fill up the portion of the internal passageway 313 of the resilient conduit 311 between the first location 370 and the PCL reservoir 300, The first location 370 thereby delineates the lower bound of the metered volume 320.

However, when water flow through the liquid supply circuit 150 is activated, a substantial increase in water pressure is introduced into the valve line 403. As a result, the normally open water pressure activated valve 401 toggles to closed state while the normally closed water pressure activated valve 402 toggles to the open state. Thus, the compression of the resilient conduit 311 at the second location 371 by the normally open water pressure activated valve 401 will seal the internal passageway 313, thereby delineating an upper bound of the metered volume 320. As water continues to flow through the liquid supply circuit 150, the venturi effect created within the mixing chamber 211 by the venturi constriction 312 will draw the PCL 302 from the metered volume 320 into the mixing chamber 211, where it is mixed with water to form the mixture of water and PCL that is subsequently delivered to the faucet 30. Thus, only the metered volume 320 of the PCL 302 will be introduced into the water stream.

To this end, each of the first and second locations 370, 370 of the resilient conduit 311 may comprise first and second visual indicia 380, 381 respectively so that the resilient conduit 311 can be properly positioned during loading of the assembly of the PCL reservoir 300 and the PCL supply line 310 into the dispensing system 3000. More specifically, the first and second visual indicia 380 (which are generically illustrated as black rectangles) provide the user with a visual cue as to what portions of the resilient conduit 311 should be aligned with each of the normally open and normally closed water pressure activate valves 401, 402. As mentioned above, the first and second visual indicia 380, can take the form of colored or scored stripes, alphanumeric, sequences, "X" marks, graphical symbols, pieces of tape, sleeves, or colored portions of the resilient tube 311. Of course, the aforementioned listing is not exhaustive.

Upon cessation of the water flow through the liquid supply circuit 150, the normally open and normally closed water pressure activate valves 401, 402 will toggle back to their normal states. When this happens, a gravity driven flow of PCL 302 from the PCL reservoir 300 will fill (or replenish) the metered volume 320.

While each of the normally open and normally closed water pressure activate valves 401, 402 is disclosed above as being a "pinch" type valve, the invention is not so limited, in other embodiments, the normally open and normally closed water pressure activate valves 401 402 can be needle type valves or any other type of valves that can be actuated by water pressure.

In certain embodiments, it may be preferred to locate the valve unit 400 downstream of the PCFC device 209 so that the normally open and normally closed water pressure activate valves 401, 402 can be properly calibrated so as to actuate in a predictable, reliable and reproducible manner. in other embodiments, however, the valve unit 400 may be upstream of the PCFC device 209. In still other embodiments, the PCFC device 209 may be omitted.

While the foregoing description and drawings represent the exemplary embodiments of the present invention, it will be understood that various additions, modifications and substitutions may be made therein without departing from the spirit and scope of the present invention as defined in the accompanying claims in particular, it will be clear to those skilled in the an that the present invention may be embodied in other specific forms, structures, arrangements, proportions, sizes, and with other elements, materials, and components, without departing from the spirit or essential characteristics thereof One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A dispensing system comprising:
a faucet;
a personal care liquid (PCL) reservoir;
a PCL supply line fluidly coupled to the PCL reservoir;
a water supply line;
a mixing unit comprising:
a first passageway extending from a water inlet to an outlet, the first passageway comprising a mixing chamber comprising a venturi constriction;
a second passageway extending from a PCL inlet to a PCL outlet in the mixing chamber; and
a pressure compensating flow control (PCFC) device operably disposed in the first passageway between the venturi constriction and the water inlet;
the water supply line fluidly coupled to the water inlet of the mixing unit and the PCL supply line fluidly coupled to the PCL inlet;
a dispensing line fluidly coupled to the outlet of the first passageway of the mixing unit and to the faucet;
a shutoff valve operably coupled to the PCL supply line between the PCL reservoir and the PCL inlet, the shutoff valve actuatable between: (1 ) a closed position in which the shutoff valve stops flow from the PCL reservoir to the mixing unit; and (2) an open position in which the shutoff valve allows flow from the PCL reservoir to the mixing unit;
a timer;
a controller operably coupled to the shutoff valve and the timer; and
the controller configured to: (1) activate flow of water; (2) actuate the shutoff valve from the closed position to the open position and activate the timer; and (3) upon expiration of the timer, actuate the shutoff valve from the open position to the closed position.

2. The dispensing system according to claim 1 wherein the PCFC device comprises a restriction that is variable in response to variations in water pressure upstream of the PCFC device.

3. The dispensing system according to claim 2 wherein the PCFC device comprises a restricting element that responds to mechanical force directly imparted on the restricting element by the water in the water supply line to vary size of the restriction.

4. The dispensing system according to claim 1 wherein the PCFC device is configured to maintain a substantially constant flow rate of water through the venturi constriction during fluctuation in water pressure upstream of the PCFC device.

5. The dispensing system according to claim 1 wherein the dispensing system is free of a pump that forces PCL into the mixing chamber, and wherein introduction of PCL into the mixing chamber is the sole result of a venturi effect caused by the venturi constriction and/or gravity.

6. The dispensing system according to claim 1 wherein the PCL supply line comprises a resilient conduit having a free end configured to be detachably coupled to the PCL inlet of the mixing unit.

7. A dispensing system comprising:
a faucet;
a personal care liquid (PCL) reservoir;
a PCL supply line fluidly coupled to the PCL reservoir;
a water supply line;
a mixing unit comprising:
a first passageway extending from a water inlet to an outlet, the first passageway comprising a mixing chamber comprising a venturi constriction;
a second passageway extending from a PCL inlet to a PCL outlet in the mixing chamber; and
a pressure compensating flow control (PCFC) device operably disposed in the first passageway between the venturi constriction and the water inlet;
the water supply line fluidly coupled to the water inlet of the mixing unit and the PCL supply line fluidly coupled to the PCL inlet;
a dispensing line fluidly coupled to the outlet of the first passageway of the mixing unit and to the faucet;
wherein the PCL supply line comprises a resilient conduit; and
a pinch valve operably coupled to the resilient conduit, the pinch valve actuatable between: (1) a closed position in which the pinch valve compresses the resilient conduit at a first location to seal the resilient conduit; and (2) an open position in which the pinch valve does not compress the resilient conduit so that PCL can freely flow through the resilient conduit.

8. The dispensing system according to claim 7 wherein a metered volume exists between the first location of the resilient conduit and a metered orifice of the second passageway of the mixing unit.

9. The dispensing system according to claim 8 wherein the first location of the resilient conduit comprises visual indicia.

10. The dispensing system according to claim 9 wherein a gravity driven flow of PCL from the PCL reservoir fills the metered volume when the pinch valve is in the open state.

11. The dispensing system according to claim 10 wherein the size of the metered orifice, the viscosity of the PCL, the size of the venturi constriction and the output pressure of the PCFC device are selected so that the PCL does not flow through the metered orifice absent a venturi effect being created in the mixing chamber.

12. The dispensing system according to claim 9 further comprising:
a controller operably coupled to the pinch valve; and
the controller configured to: (1) actuate the pinch valve into the closed state upon flow of water through the dispensing system being activated; and (2) actuate the pinch valve into the open state upon flow of water through the dispensing system being terminated.

13. The dispensing system according to claim 9 further comprising:
a timer;
a controller operably coupled to the pinch valve and the timer; and
the controller configured to: (1) activate flow of water; (2) actuate the pinch valve from the closed state to the open state and activate the timer; and (3) upon expiration of the timer, actuate the pinch valve from the open state to the closed state.

14. The dispensing system according to claim 1 further comprising:

a three way valve operably coupled to the water supply line; and a bypass line operably coupled to the three way valve and fluidly coupled to the dispensing line;

the three way valve actuatable between: (1) a first state in which water flow is directed through mixing unit and prohibited from flowing through the bypass line; and (2) a second state in which water flow is directed through the bypass line and prohibited from flowing through the mixing unit.

15. A dispensing system comprising:

a faucet;

a personal care liquid (PCL) reservoir;

a PCL supply line fluidly coupled to the PCL reservoir and comprising a resilient conduit having a free end;

a pinch valve operably coupled to the resilient conduit, the pinch valve actuatable between: (1) a closed position in which the pinch valve compresses the resilient conduit at a first location to seal the resilient conduit; and (2) an open position in which the pinch valve does not compress the resilient conduit so that PCL can freely flow through the resilient conduit;

a water supply line;

a mixing unit comprising:

a first passageway extending from a water inlet to an outlet, the first passageway comprising a mixing chamber comprising a venturi constriction;

a second passageway extending from a PCL inlet to a PCL outlet in the mixing chamber;

the water supply line fluidly coupled to the water inlet of the mixing unit and the free end of the resilient conduit of the PCL supply line detachably coupled to the PCL inlet in a fluid-tight manner; and a dispensing line fluidly coupled to the outlet of the first passageway of the mixing unit and to the faucet.

16. The dispensing system according to claim 15 wherein a metered volume is defined between the first location of the resilient conduit and a metered orifice of the second passageway of the mixing unit, and wherein the metered volume corresponds to a predetermined PCL single-use dosage.

17. The dispensing system according to claim 15 further comprising:

a timer;

a controller operably coupled to the pinch valve and the timer; and the controller configured to: (1) activate flow of water; (2) actuate the pinch valve from the closed state to the open state and activate the timer; and (3) upon expiration of the timer, actuate the pinch valve from the open state to the closed state.

* * * * *